US011293231B2

(12) United States Patent
Liu et al.

(10) Patent No.: US 11,293,231 B2
(45) Date of Patent: Apr. 5, 2022

(54) MULTI-PATH COMBINED HIGH-LOW VOLTAGE PLASMA DRILLING METHOD, DRILL BIT FOR DRILLING AND DRILL BIT APPARATUS FOR DRILLING

(71) Applicant: China University of Petroleum (East China), Shandong (CN)

(72) Inventors: Yonghong Liu, Shandong (CN); Qiang Sun, Shandong (CN); Qingyun Li, Shandong (CN); Renjie Ji, Shandong (CN); Baoping Cai, Shandong (CN); Xiaopeng Li, Shandong (CN); Yancong Han, Shandong (CN); Peng Liu, Shandong (CN); Xinlei Wu, Shandong (CN); Hang Dong, Shandong (CN); Fan Zhang, Shandong (CN)

(73) Assignee: China University of Petroleum (East China), Shandong (CN)

( * ) Notice: Subject to any disclaimer, the term of this patent is extended or adjusted under 35 U.S.C. 154(b) by 0 days.

(21) Appl. No.: 16/735,417

(22) Filed: Jan. 6, 2020

(65) Prior Publication Data

US 2020/0224498 A1 Jul. 16, 2020

(30) Foreign Application Priority Data

Jan. 11, 2019 (CN) ..... 201910025325.8

(51) Int. Cl.
*E21B 7/15* (2006.01)
*E21B 10/60* (2006.01)

(52) U.S. Cl.
CPC ..... *E21B 7/15* (2013.01); *E21B 10/60* (2013.01)

(58) Field of Classification Search
CPC ..... E21B 10/60; E21B 7/15; E21B 7/14
See application file for complete search history.

(56) References Cited

U.S. PATENT DOCUMENTS 9,279,322 B2 * 3/2016 Dirksen ..... E21B 10/61
10,378,284 B2 * 8/2019 Bayol ..... E21B 41/0085
(Continued)

FOREIGN PATENT DOCUMENTS

CN 2826819 Y 10/2006
CN 102678044 A 9/2012
(Continued)

OTHER PUBLICATIONS

Zhang Z, Rock Fragmentation by Pulsed High Voltage Discharge and Drilling Equipment Development, 2013, China.

*Primary Examiner* — Caroline N Butcher
(74) *Attorney, Agent, or Firm* — IP & T Group LLP

(57) ABSTRACT

A multi-path combined high-low voltage plasma drilling method, a drill bit for drilling and a drill bit apparatus for drilling utilizing this method. The drilling method includes: disposing a plurality of mutually independent plasma generators on a plasma drill bit, wherein the plasma generators are independently connected to a plasma power source on the ground through wires; allowing each of the plasma generators to eject high-frequency pulsed plasma arc under the control of its corresponding combined high-low voltage pulse power source on the ground; ejecting the high-frequency pulsed plasma arc onto a wall of a drilling well, forming impulsive high temperature thermal shock stress inside the rocks on the wall of the drilling well; and breaking the rocks under the shock of thermal stress to form rock debris.

10 Claims, 2 Drawing Sheets

(56) References Cited

U.S. PATENT DOCUMENTS

| | | | | |
|---|---|---|---|---|
| 2012/0132466 | A1 | 5/2012 | Moeny | |
| 2013/0140086 | A1* | 6/2013 | Moeny | E21C 37/18<br>175/16 |

FOREIGN PATENT DOCUMENTS

| | | | |
|---|---|---|---|
| CN | 203614039 | U | 5/2014 |
| CN | 105444631 | A | 3/2016 |
| CN | 207199999 | U | 4/2018 |
| CN | 108222838 | A | 6/2018 |
| CN | 108222839 | A | 6/2018 |
| CN | 108267053 | A | 7/2018 |
| CN | 108871130 | A | 11/2018 |
| CN | 208158968 | U | 11/2018 |
| CN | 109736710 | A | 5/2019 |

* cited by examiner

MULTI-PATH COMBINED HIGH-LOW VOLTAGE PLASMA DRILLING METHOD, DRILL BIT FOR DRILLING AND DRILL BIT APPARATUS FOR DRILLING

The present application claims priority under 35 U.S.C. § 119(a) to Chinese Patent Application No. 2019100253258, filed on Jan. 11, 2019, the disclosure of which is incorporated herein by reference in its entirety.

BACKGROUND

Technical Field

The present application belongs to the field of oil engineering, and in particular relates to a multi-path combined high-low voltage plasma drilling method, a drill bit for drilling and a drill bit apparatus for drilling.

Description of the Related Art

Drilling technology is the core technology in the development of oil and gas resources. Rotating machinery drilling is the most commonly used method which use a drill bit to break rocks in a way of "hard against soft". However, with the increase in the depth of exploration and development of petroleum resources, geological conditions are more and more complex, and the difficulty in breaking rocks is increasing. The inadaptability of rotating machinery drilling technologies has become increasingly prominent, which is mainly manifested in the serious wear of drill bits, low rock breaking efficiency, slow drilling speed and high cost. Plasma rock-breaking drilling is a new type of drilling technology which is configured to break rocks using the effects of plasma thermal energy impact, melting and so on. The method can overcome detects of the traditional rotary machinery rock-breaking method since the rock-breaking effect thereof is not affected by the hardness and strength of rock, and it is a new efficient, economical and environmentally-friendly oil and gas drilling method. At present, the plasma drilling technology is divided into high-voltage pulsed plasma rock-breaking technology and plasma arc ablation rock-breaking technology.

The high-voltage pulse plasma drilling method comprises connecting the inner and outer electrodes to the positive and negative electrodes of the high-voltage pulse power source respectively; transmitting high-voltage pulses of several tens to hundreds of kilovolts to the subsurface inner and outer electrodes through cables by the high-voltage pulse power source during breaking rocks, puncturing the rocks at the front ends of the inner and outer electrodes by discharge, and forming a plasma discharge channel; raising the pressure in the plasma channel sharply to 3-10 Gpa and rapidly expands, such that the rocks are broken and cracked; and continuously repeating the pulsed plasma discharge process to achieve high-efficiency rock-breaking and drilling. However, since the dielectric properties of drilling fluid are often lower than that of the rocks, the breakdown channel of the plasma occurs in the drilling fluid, causing that the rock breaking efficiency is low and the tool electrode loss is large, so the drilling method has the disadvantages of poor working stability and high energy consumption. Moreover, the method requires a plasma discharge breakdown high voltage of several tens to hundreds of kilovolts, and it is difficult to design the rock-breaking power source and the high voltage transmission system for the method.

The plasma arc ablation rock-breaking technology is to eject high temperature plasma from a special plasma drill bit and directly spray it onto the rocks to melt, vaporize and thermally break the rocks, thereby realizing drilling. This technology has the disadvantages of difficulty in the design of ultra-high power source, large drill bit loss, low energy utilization and small drilling wellbore.

BRIEF SUMMARY

To overcome the deficiencies of the prior art, the present disclosure provides a multi-path combined high-low voltage plasma drilling method, a drill bit for drilling and a drill bit apparatus for drilling.

An embodiment of the present disclosure provides a multi-path combined high-low voltage plasma drilling method, comprising: disposing a plurality of mutually independent plasma generators on a plasma drill bit, wherein the plasma generators are independently connected to a plasma power source on the ground through wires; allowing each of the plasma generators to eject high-frequency pulsed plasma arc under the control of its corresponding combined high-low voltage pulse power source on the ground; ejecting the high-frequency pulsed plasma arc onto a wall of a drilling well, forming impulsive high temperature thermal shock stress inside rocks on the wall of the drilling well; and breaking the rocks under the shock of thermal stress to form rock debris.

In an embodiment of the present disclosure, the plasma drill bit makes reciprocating rotation movement in the range of 360° under the driving of a ground control system; and the plasma arcs ejected by the plurality of plasma generators jointly scan the entire wellbore area.

In an embodiment of the present disclosure, high-pressure drilling fluid is pumped from the ground and ejected through drilling fluid outlets; the drilling fluid discharges the rock debris from the gaps between the plasma drill bit and the rocks and carries it to the ground.

According to a second aspect, an embodiment of the present disclosure provides a drill bit for drilling, comprising a drill bit body whose drilling surface is provided with a plurality of plasma generators and drilling fluid outlets, wherein each plasma generator is configured to be electrically connected to its corresponding combined high-low voltage pulse power source; and the drilling fluid outlets are configured to be in communication with a drilling fluid supply apparatus.

In an embodiment of the present disclosure, a center-position plasma generator is disposed at a central position of the drilling surface of the drill bit body; and a plurality of side-position plasma generators are disposed on the drilling surface by way of outward radiation centering on the central position, and each of the center-position plasma generator and the side-position plasma generators is configured to be electrically connected to its corresponding combined high-low voltage pulse power source.

In an embodiment of the present disclosure, the drilling fluid outlets are disposed around the plasma generators.

According to a third aspect, an embodiment of the present disclosure provides a drill bit apparatus for drilling, comprising a drill bit and a driving device, wherein the drill bit is the above-mentioned drill bit for drilling, and the driving device is linked with the drill bit for driving the drill bit to rotate reciprocally in the range of 360°.

In an embodiment of the present disclosure, the drill bit apparatus for drilling further comprises the combined high-low voltage pulse power sources and a drilling fluid supply apparatus; each plasma generator is electrically connected to its corresponding combined high-low voltage pulse power source; and drilling fluid outlets are in communication with the drilling fluid supply apparatus.

According to a fourth aspect, an embodiment of the present disclosure provides a drilling method, the drilling method uses the above-mentioned drill bit apparatus for drilling process and comprises: rotating the drill bit at the bottom of a drilling well, allowing a plurality of combined high-low voltage pulse power sources to control the corresponding plasma generators respectively during the rotation process, so that the plasma generators emit high-frequency pulsed plasma arcs to break rocks on the wall of the drilling well.

In an embodiment of the present disclosure, the drilling method further comprises releasing drilling fluid by the drilling fluid supply apparatus to the bottom of the drilling well through the drilling fluid outlets in the process that the plasma generators emit high-frequency pulsed plasma arcs.

According to the multi-path combined high-low voltage plasma drilling method, a drill bit for drilling and a drill bit apparatus for drilling provided by the embodiment of the present disclosure, by disposing the plurality of plasma generators and making each plasma generator have an independent combined high-low voltage pulse power source to provide energy, it is not necessary to design a power source with large power, electrode loss of the drill bit is reduced, the rock-breaking operation can be performed at a large bottom area of the drilling well from multiple angles, and the high drilling energy utilization rate is achieved. In addition, by disposing the drilling fluid outlets around the plasma generators, the plasma generators surrounded by the drilling fluid can be uniformly cooled when the drilling fluid is released from the drilling fluid outlets, and at the same time the surrounding rock debris can be mixed and pulled and then discharged and carried to the ground by the gap between the plasma drill bit and the wall of the drilling well.

BRIEF DESCRIPTION OF THE DRAWINGS

In order to more clearly illustrate the technical solutions disclosed in the embodiments of the present disclosure or the prior art, the drawings used in the descriptions of the embodiments or the prior art will be briefly described below. Obviously, the drawings in the following description are only certain embodiments of the present disclosure, and other drawings can be obtained according to these drawings without any creative work for those skilled in the art.

DETAILED DESCRIPTION

In order to make the object, technical solutions and advantages of the embodiments of the present disclosure more clear, the technical solutions in the embodiments of the present disclosure are clearly and completely described below in conjunction with the accompanying drawings in the embodiments of the present disclosure. Obviously, the described embodiments are part of the embodiments of the present disclosure, and not all of the embodiments. All other embodiments obtained by a person of ordinary skill in the art based on the embodiments of the present disclosure without any creative work belong to the scope of the present disclosure.

Figure 1:
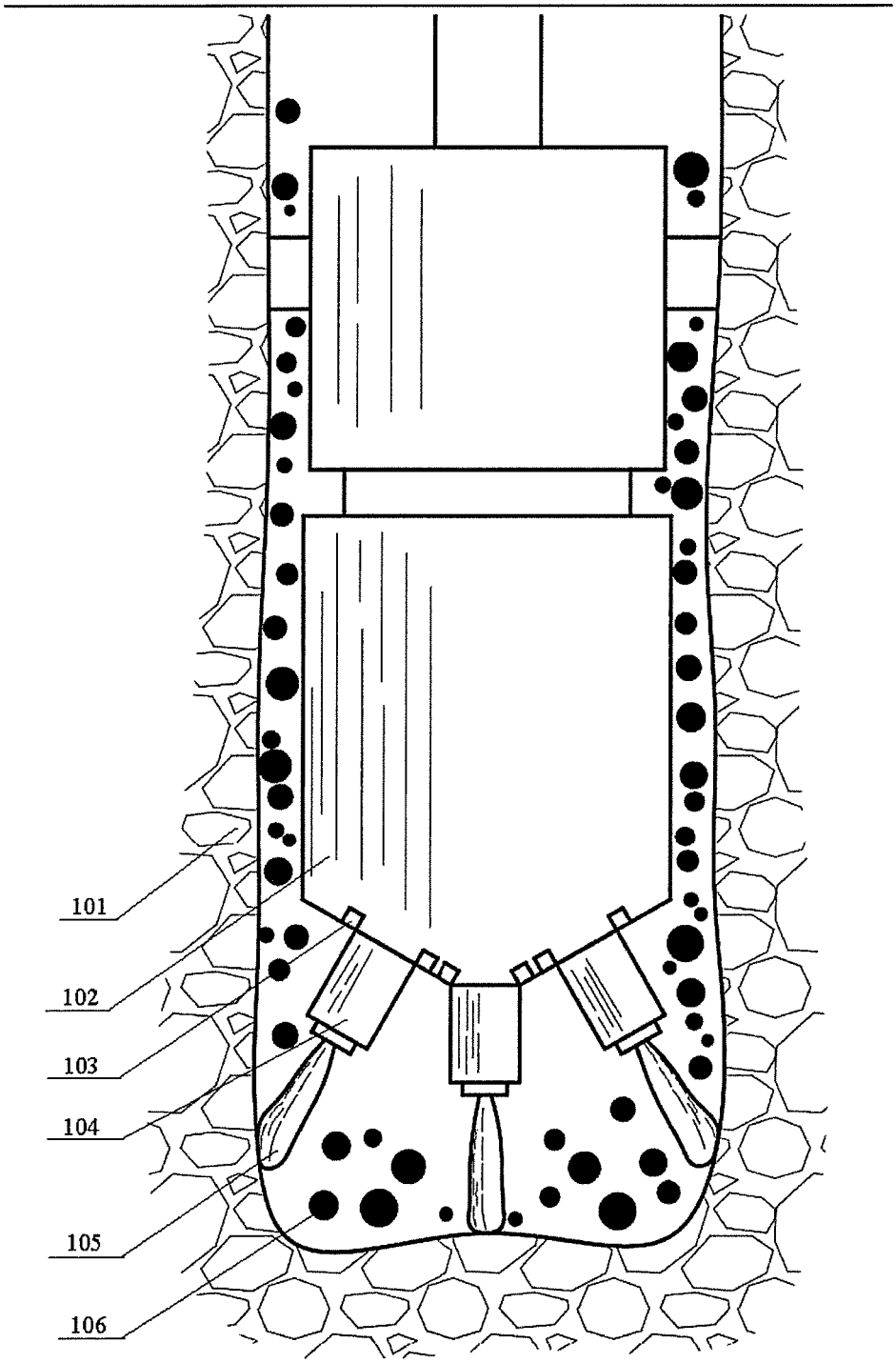
FIG. 1 is a schematic diagram of a multi-path combined high-low voltage plasma drilling principle according to an embodiment of the present disclosure.

FIG. 1 shows a schematic diagram of a multi-path combined high-low voltage plasma drilling principle according to an embodiment of the present disclosure. The multi-path combined high-low voltage plasma drilling method provided by the embodiment of the present disclosure is specifically as follows: a plurality of mutually independent plasma generators 104 are arranged on a plasma drill bit 102, and the plasma generators are independently connected to a plasma power source on the ground through conductive wires; each of the plasma generators eject high-frequency pulsed plasma arc 105 under the control of its corresponding combined high-low pressure pulse power source on the ground; the high-frequency pulsed plasma arc 105 is ejected onto a wall 101 of a drilling well, impulsive high temperature thermal shock stress is formed inside the rocks on the wall 101 of the drilling well, and the rocks are broken under the shock of thermal stress to form rock debris 106; high-pressure drilling fluid is pumped from the ground and is sprayed through the drilling fluid outlets 103; the drilling fluid cools the plasma generators 104; the drilling fluid discharges the rock debris 106 from the gap between the plasma drill bit and the rocks and carries it to the ground; the plasma drill bit makes reciprocating rotation movement in the range of 360° under the driving of a ground control system; and the plasma arcs ejected from the plurality of plasma generators 104 jointly scan the entire wellbore area for efficient rock-breaking and drilling.

Figure 2:
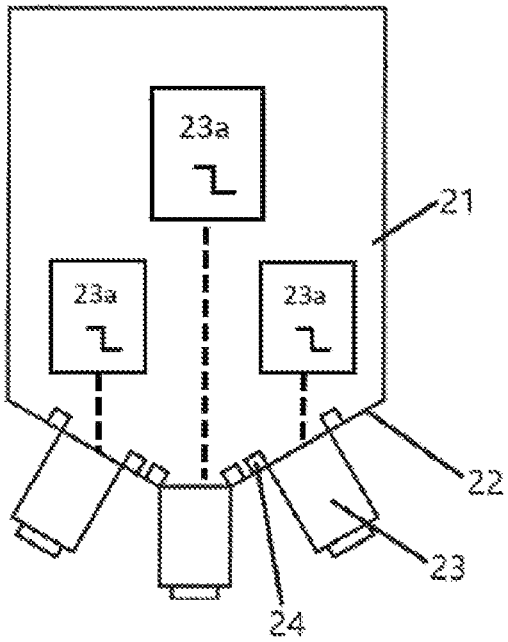
FIG. 2 is a schematic structural view of a drill bit for drilling according to an embodiment of the present disclosure.

FIG. 2 shows a schematic structural view of a drill bit for drilling according to an embodiment of the present disclosure. As can be seen from FIG. 2, the drill bit comprises a drill bit body 21 whose drilling surface 22 is provided with a plurality of plasma generators 23 and drilling fluid outlets 24, wherein each plasma generator 23 is configured to be electrically connected to its corresponding combined high-low voltage pulse power source 23*a*; and the drilling fluid outlets 24 are configured to be in communication with a drilling fluid supply apparatus.

It should be noted that since the drill bit is provided with the plurality of plasma generators and each plasma generator has an independent combined high-low voltage pulse power source to provide energy, it is not necessary to design a power source with large power, electrode loss of the drill bit is reduced, the rock-breaking operation can be performed at a large bottom area of the drilling well from multiple angles, and the high drilling energy utilization rate is achieved.

In a further embodiment of the drill bit for drilling of the embodiment above, in order to better perform uniform operation on the bottom area of the drilling well, a center-position plasma generator is disposed at a central position of the drilling surface of the drill bit body; and a plurality of side-position plasma generators are disposed on the drilling surface by way of outward radiation centering on the central position, and each of the center-position plasma generator and the side-position plasma generators is configured to be electrically connected to its corresponding combined high-low voltage pulse power sources.

In a further embodiment of the drill bit of the embodiment above, by disposing the drilling fluid outlets around the plasma generators, the plasma generators surrounded by the drilling fluid can be uniformly cooled when the drilling fluid is released from the drilling fluid outlets, and at the same time the surrounding rock debris can be mixed and pulled and then discharged and carried to the ground by the gap between the plasma drill bit and the wall of the drilling well.

An embodiment of the present disclosure provides a drill bit apparatus for drilling, comprising a drill bit and a driving device, wherein the drill bit is the drill bit for drilling mentioned in the above embodiments, and the driving device is linked with the drill bit for driving the drill bit to rotate reciprocally in the range of 360°, thereby performing rock-breaking operation at a relatively large bottom area from multiple angles on the bottom of the drilling well and achieving the purpose of high utilization efficiency of the drilling energy.

In a further embodiment of the drill bit apparatus for drilling of the embodiment above, the drill bit apparatus for drilling further comprises combined high-low voltage pulse power sources and a drilling fluid supply apparatus; each plasma generator is electrically connected to its corresponding combined high-low voltage pulse power source; and the drilling fluid outlets are in communication with the drilling fluid supply apparatus.

When the drill bit apparatus mentioned in the above embodiments performs the drilling operation, each of the plasma generator eject high-frequency pulsed plasma arc under the control of its corresponding combined high-low voltage pulse power source on the ground; the high-frequency pulsed plasma arc is ejected onto a wall of a drilling well, impulsive high temperature thermal shock stress is formed inside the rocks on the wall of the drilling well, and the rocks are broken under the shock of thermal stress to form rock debris; high-pressure drilling fluid is pumped from the ground and is sprayed through the drilling fluid outlets; the drilling fluid cools the plasma generators; the drilling fluid discharges the rock debris from the gap between the plasma drill bit and the rocks and carries it to the ground; the plasma drill bit makes reciprocating rotation movement in the range of 360° under the driving of a ground control system; and the plasma arcs ejected from the plurality of plasma generators jointly scan the entire wellbore area for efficient rock-breaking and drilling.

Figure 3:
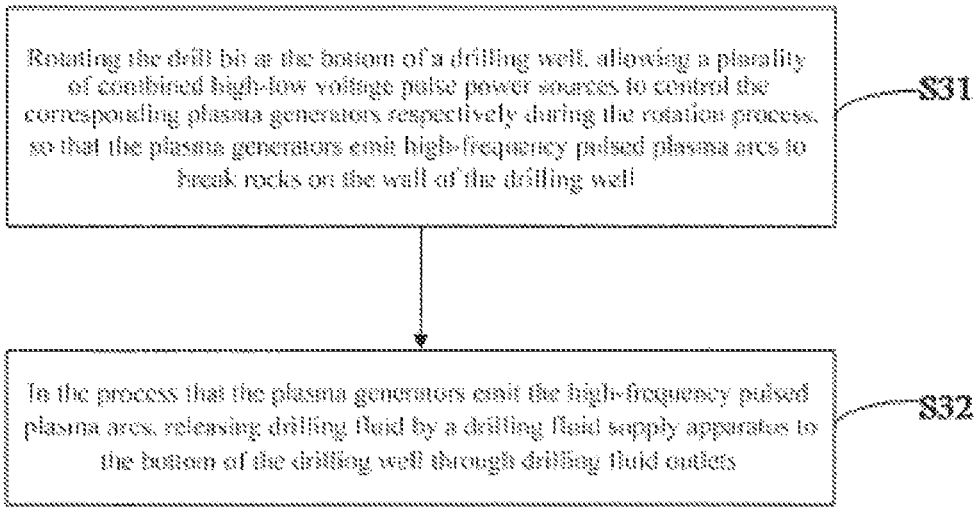
FIG. 3 is a flow chart of a multi-path combined high-low voltage plasma drilling method according to an embodiment of the present disclosure.

FIG. 3 shows a flow chart of a multi-path combined high-low voltage plasma drilling method according to an embodiment of the present disclosure. The drilling method uses the above-mentioned drill bit apparatus for drilling process and comprises: S31, rotating the drill bit at the bottom of a drilling well, allowing a plurality of combined high-low voltage pulse power sources to control the corresponding plasma generators respectively during the rotation process, so that the plasma generators emit high-frequency pulsed plasma arcs to break rocks on a wall of the drilling well; and S32, in the process that the plasma generators emit the high-frequency pulsed plasma arcs, releasing drilling fluid by a drilling fluid supply apparatus to the bottom of the drilling well through drilling fluid outlets.

According to the drilling method, by disposing the plurality of plasma generators and making each plasma generator have an independent combined high-low voltage pulse power source, it is not necessary to design a power source with large power, electrode loss of the drill bit is reduced, the rock-breaking operation can be performed at a large bottom area of the drilling well from multiple angles, and the high drilling energy utilization rate is achieved. In addition, by disposing the drilling fluid outlets around the plasma generators, the plasma generators surrounded by the drilling fluid can be uniformly cooled when the drilling fluid is released from the drilling fluid outlets, and at the same time the surrounding rock debris can be mixed and pulled and then discharged and carried to the ground by the gap between the plasma drill bit and the wall of the drilling well.

Through the description of the embodiments above, those skilled in the art can clearly understand that the various embodiments can be implemented by means of software and a necessary general hardware platform, and of course, by hardware. Based on such understanding, the above-mentioned technical solutions in essence or a part thereof that contributes to the prior art, may be embodied in the form of a software product, which may be stored in a computer-readable storage medium such as ROM/RAM, magnetic Discs, optical discs, etc., including several instructions to cause a computer device (which may be a personal computer, server, or network device, etc.) to perform various embodiments or the methods described by part of the various embodiments.

Finally, it should be noted that the above embodiments are only used to explain the technical solutions of the present disclosure, and are not limited thereto; although the present disclosure is described in detail with reference to the foregoing embodiments, it should be understood by those skilled in the art that they can still modify the technical solutions described in the foregoing embodiments and make equivalent replacements to a part of the technical features therein; and these modifications and replacements do not depart from the spirit and scope of the technical solutions of the embodiments of the present disclosure.

The invention claimed is:

1. A multi-path combined high-low voltage plasma drilling method, comprising:

disposing a plurality of mutually independent plasma generators on a plasma drill bit, wherein the plasma generators are independently connected to a plasma power source;

allowing each of the plasma generators to eject a high-frequency pulsed plasma arc under the control of its corresponding combined high-low voltage pulse power source;

ejecting the high-frequency pulsed plasma arc from one of the plasma generators onto a wall of a drilling well;

forming impulsive high temperature thermal shock stress inside rocks on the wall of the drilling well; and breaking the rocks by thermal shock and the high temperature thermal shock stress inside the rocks to form rock debris.

2. The multi-path combined high-low voltage plasma drilling method of claim 1, wherein the plasma drill bit makes reciprocating rotation movement in the range of 360° under the driving of a ground control system; and the plasma arcs ejected from the plurality of plasma generators jointly scan the entire wellbore area.

3. The multi-path combined high-low voltage plasma drilling method of claim 1, wherein high-pressure drilling fluid is pumped from the ground and sprayed through drilling fluid outlets; and the drilling fluid discharges the rock debris from the gap between the plasma drill bit and the rocks and carries it to the ground.

4. A drill bit for drilling, comprising:

a drill bit body whose drilling surface is provided with a plurality of plasma generators and drilling fluid outlets, wherein each plasma generator is configured to be electrically connected to its corresponding combined high-low voltage pulse power source; and the drilling fluid outlets are configured to be in communication with a drilling fluid supply apparatus, wherein each plasma generator is configured to eject a high-frequency pulsed plasma arc therefrom and onto a wall of a drilling well, wherein the high-frequency pulsed plasma arc ejected from the plasma generator forms impulsive high temperature thermal shock stress inside rocks on the wall of the drilling well, and wherein the high-frequency pulsed plasma arc ejected from the plasma generator breaks the rocks by thermal shock and the high temperature thermal shock stress inside the rocks to form rock debris.

5. The drill bit for drilling of claim 4, wherein a center-position plasma generator is disposed at a central position of the drilling surface of the drill bit body; and a plurality of side-position plasma generators are disposed on the drilling surface by way of outward radiation centering on the central position, and each of the center-position plasma generator and the side-position plasma generators is configured to be electrically connected to its corresponding combined high-low voltage pulse power source.

6. The drill bit for drilling of claim 5, wherein the drilling fluid outlets are disposed around the plasma generators.

7. A drill bit apparatus for drilling, comprising a drill bit and a driving device, wherein the drill bit is the drill bit for drilling according to claim 4, and the driving device is linked with the drill bit for driving the drill bit to rotate reciprocally in the range of 360°.

8. A drill bit apparatus for drilling of claim 7, further comprising the combined high-low voltage pulse power sources and a drilling fluid supply apparatus; each plasma generator is electrically connected to its corresponding combined high-low voltage pulse power source; and drilling fluid outlets are in communication with the drilling fluid supply apparatus.

9. A multi-path combined high-low voltage plasma drilling method, adopting the drill bit apparatus for drilling according to claim 7, the method comprising:

rotating the drill bit at the bottom of a drilling well, allowing a plurality of combined high-low voltage pulse power sources to control the corresponding plasma generators respectively during the rotation process, so that the plasma generators emit high-frequency pulsed plasma arcs to break rocks on a wall of the drilling well.

10. The multi-path combined high-low voltage plasma drilling method of claim 9, further comprising releasing drilling fluid by a drilling fluid supply apparatus to the bottom of the drilling well through the drilling fluid outlets while the plasma generators emit high-frequency pulsed plasma arcs.

* * * * *